US009963765B2

(12) United States Patent
Yamamoto et al.

(10) Patent No.: US 9,963,765 B2
(45) Date of Patent: May 8, 2018

(54) COPPER ALLOY FOR USE IN A MEMBER FOR USE IN WATER WORKS

(71) Applicant: KURIMOTO, LTD., Osaka (JP)

(72) Inventors: Masaaki Yamamoto, Osaka (JP); Hiroshi Yamada, Osaka (JP); Takeaki Miyamoto, Osaka (JP); Syohei Matsuba, Osaka (JP)

(73) Assignee: KURIMOTO, LTD., Osaka (JP)

( * ) Notice: Subject to any disclaimer, the term of this patent is extended or adjusted under 35 U.S.C. 154(b) by 178 days.

(21) Appl. No.: 14/896,497

(22) PCT Filed: Dec. 3, 2013

(86) PCT No.: PCT/JP2013/082481
§ 371 (c)(1),
(2) Date: Dec. 7, 2015

(87) PCT Pub. No.: WO2014/199530
PCT Pub. Date: Dec. 18, 2014

(65) Prior Publication Data

US 2016/0130684 A1 May 12, 2016

(30) Foreign Application Priority Data

Jun. 12, 2013 (JP) ..... 2013-123582

(51) Int. Cl.
*C22C 9/04* (2006.01)
*C22C 1/02* (2006.01)
*B22D 21/00* (2006.01)

(52) U.S. Cl.
CPC ..... *C22C 9/04* (2013.01); *B22D 21/00* (2013.01); *C22C 1/02* (2013.01)

(58) Field of Classification Search
CPC ..... B22D 21/00; C22C 1/02; C22C 9/04
USPC ..... 420/472
See application file for complete search history.

(56) References Cited

U.S. PATENT DOCUMENTS 5,942,056 A * 8/1999 Singh ..... C22C 9/04 148/434
2006/0005901 A1 1/2006 Kurose et al.
2009/0014097 A1 1/2009 Oishi
2009/0297390 A1 12/2009 Hidenobu et al.

FOREIGN PATENT DOCUMENTS

| | | | |
|---|---|---|---|
| CN | 1993487 | 7/2007 | |
| CN | 101024867 | 8/2007 | |
| JP | 7-310133 | 11/1995 | |
| JP | 8-120369 | 5/1996 | |
| JP | 2889829 | 2/1999 | |
| JP | 2000-336442 | 12/2000 | |
| JP | 2002-60868 | 2/2002 | |
| JP | 2002-302722 | 10/2002 | |
| JP | 2008-208433 | 9/2006 | |
| JP | 2008-156670 | 7/2008 | |
| JP | 4294793 | 4/2009 | |
| JP | 2010-31375 | 2/2010 | |
| JP | 2011214095 A * | 10/2011 | ..... B22D 21/025 |
| JP | 4866717 | 11/2011 | |
| KR | 10-0940593 | 2/2010 | |

OTHER PUBLICATIONS

NPL: Machine translation of JP-2011214095A, Oct. 2011.*
International Search Report dated Feb. 25, 2014 in corresponding International Application No. PCT/JP2013/082481 (with English translation).
Notification of First Office Action dated Aug. 11, 2016 in corresponding Chinese Application No. 201380076867.9 (with English translation).

* cited by examiner

*Primary Examiner* — Jie Yang
(74) *Attorney, Agent, or Firm* — Wenderoth, Lind & Ponack, L.L.P.

(57) ABSTRACT

A copper alloy for use in water works has not only a reduced lead content and the lowest possible Ni content, but also a reduced Bi content, and still exhibits suitable properties. The copper alloy includes: less than 0.5% by mass of Ni; 0.2% by mass or more and 0.9% by mass or less of Bi; 12.0% by mass or more and 20.0% by mass or less of Zn; 1.5% by mass or more and 4.5% by mass or less of Sn; and 0.005% by mass or more and 0.1% by mass or less of P; wherein the total content of Zn and Sn is 21.5% by mass or less, and the balance is a trace element(s) and Cu.

2 Claims, 9 Drawing Sheets

| Names of shapes of machining chips | Shape | Evaluation |
|---|---|---|
| Straight machining chips | | Poor (x) |
| Helically-coiled machining chips | | |
| Cylindrical machining chips | | |
| Spiral, or spiral-tipped machining chips | | Good (O) |
| Broken machining chips | | |
| Sheared machining chips | | |

(a)

(b)

(a) Example5

(b) Example2

(a) Example3

(b) Comparative Example3

COPPER ALLOY FOR USE IN A MEMBER FOR USE IN WATER WORKS

TECHNICAL FIELD

The present invention relates to a material for use in a member for water works, which member is made of a copper alloy and in which the level of lead leaching is not more than a stipulated value.

BACKGROUND ART

JIS H5120 CAC406, a bronze alloy which has been conventionally used for parts in materials and equipment for water works and in feed water supply system, contains from 4.0 to 6.0% by weight of lead, and the lead leaching therefrom into the tap water has been frequently observed. Therefore, in order to reduce the amount of toxic lead leaching, the production of a copper alloy containing a reduced amount of lead, or a lead-free copper alloy which contains no lead has been investigated.

However, when a copper alloy is produced without lead, or with a reduced amount of lead, the castability, machinability, and/or the water pressure resistance of the resulting copper alloy are reduced, thereby causing the leaking of water when the alloy is used in a valve, for example. Therefore, an alloy has been investigated in which not only the content of lead is reduced, but also the deterioration of functional properties, such as a decrease in the water pressure resistance, is prevented as much as possible as compared to the alloy containing lead.

For example, JP 2889829 B describes a bronze alloy which contains from 0.5% to 6% by weight of Bi and from 0.05% to 3% by weight of Sb, to compensate for the reduced lead content. Particularly, Example 7 therein describes that a bronze alloy which contains 1.5% by weight of Sn; 17.5% by weight of Zn, 0.7% by weight of Bi, 0.06% by weight of Sb, 0.003% by weight of P, and 0.8% by weight of Ni, and in which the content of Pb is reduced to 0.1% by weight, provided suitable results.

Further, JP 4866717 B describes a copper alloy for use in a member for water works which exhibits suitable properties despite a reduced lead content, as a result of containing from 2.0% to 3.0% by weight of Ni, and from 0.5% to 1.1% by weight or less of Bi.

In addition, JP 4294793 B describes a bronze alloy which contains from 1.5% to 2.5% by mass of Bi and from 0.1% to 0.5% by mass of Ni.

However, recent researches have reported the results which suggest an undeniable possibility that the Ni, which is contained in the alloy disclosed in Example 7 of JP 2889829 B and the alloy disclosed in JP 4866717 B, could cause an allergy. Therefore, from now on, it is considered that reducing the Ni content as much as possible is preferred, even in the material for use in a member for water works. On the other hand, since the bronze alloy disclosed in JP 4294793 B contains too high an amount of Bi despite a low Ni content, it has been found that, when subjected to sand casting, the resulting casting is prone to shrinkage cavities and tends to have reduced mechanical properties.

SUMMARY OF THE INVENTION

Accordingly, an object of the present invention is to provide a copper alloy for use in a member for water works which not only has a reduced lead content and the lowest possible Ni content, but also a reduced Bi content, and which still exhibits suitable properties.

Means for Solving the Problems

The present invention has solved the above mentioned problems by adopting the following constitution.

A copper alloy comprising: less than 0.5% by mass of Ni; 0.2% by mass or more and 0.9% by mass or less of Bi;

12.0% by mass or more and 20.0% by mass or less of Zn; 1.5% by mass or more and 4.5% by mass or less of Sn; and 0.005% by mass or more and 0.1% by mass or less of P;

wherein the total content of Zn and Sn is 21.5% by mass or less, and the balance is a trace element(s) and Cu.

In other words, the present invention provides a blending ratio which allows for production of a copper alloy in which: the content of Ni is reduced in addition to reducing the content of Pb to prevent adverse effects to health; the occurrence of shrinkage cavities can be prevented during the sand casting even though the content of Bi is reduced; and, at the same time, the influence of reduced Bi content can be compensated for so that the alloy is able to exhibit sufficient mechanical properties.

If the content of Zn is too high, in particular, the solid solubility of Sn is reduced to result in an increased concentration of Sn in the residual liquid phase during the solidification. As a result, the crystallization of β-phase due to peritectic reaction is more likely to occur. Eventually, eutectoids of α+δ phases, composed of α-phases scattered in hard δ-phases, are generated between dendrites, resulting in a reduction in the material strength of the alloy and a tendency thereof to develop casting defects. It has been discovered that this effect is synergistically aggravated by the presence of Bi, which is also not solid-solubilized in Cu, but dispersed. Therefore, by adjusting the total content of Zn and Sn to a range in which Sn is allowed to solid-solubilize in Cu, while reducing the Bi content, it is possible to provide a copper alloy which has sufficient strength and which is less prone to casting defects under such an environment.

This copper alloy may also contain trace element(s) in addition to the above mentioned elements. However, it is necessary that the total content of the trace element(s) be within the range in which the effect of the present invention is not impaired. The total content is preferably less than 3.0% by mass, and more preferably less than 1.0% by mass. Further, the content of one trace element is preferably less than 1.0% by mass, and more preferably, less than 0.4% by mass. Still more preferably, the content is not more than the amount contained as an unavoidable impurity(ies), because the resulting copper alloy can be expected to have stable properties. Particularly, it is preferred that the content of Pb be less than 0.25% by mass, in order to prevent Pb leaching. In addition, the content of unavoidable impurity(ies) is preferably less than 0.5% by mass, and more preferably, less than 0.1% by mass.

If the copper alloy according to the present invention contains 0.0003% by mass or more and 0.006% by mass or less of B, as a trace element which is not an impurity, the flowability of molten metal, in particular, of the copper alloy can be significantly improved.

According to the present invention, it is possible to provide a copper alloy which has sufficient mechanical properties, which is less prone to shrinkage cavities during sand casting, and which can be easily handled, while reducing the content of Pb, and also the content of Ni, which is suspected to cause an allergy; and to produce a member for water works in which safety is further secured.

DETAILED DESCRIPTION OF THE INVENTION

Figure 1:
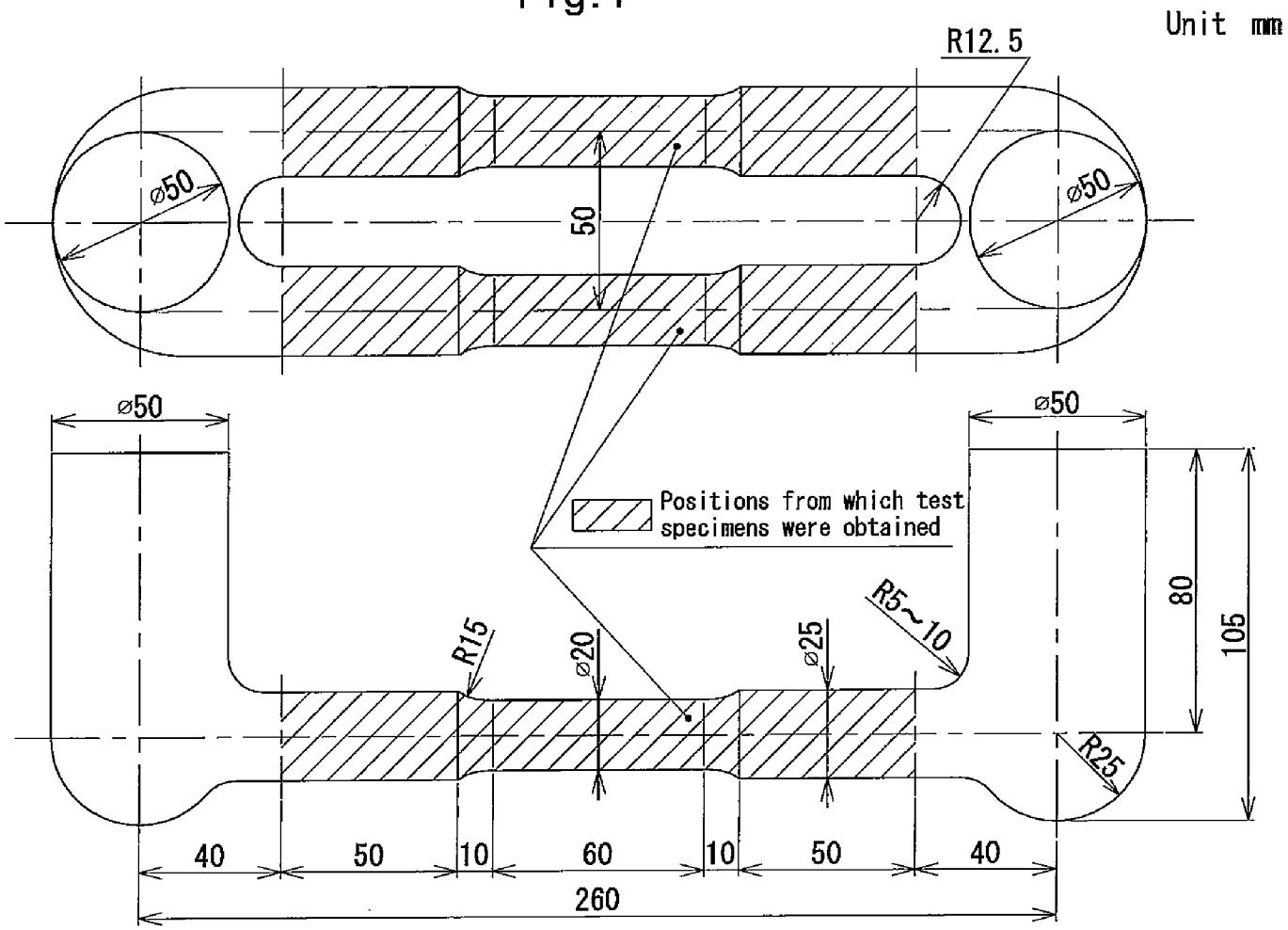
FIG. 1 is a structural view of a Type A sample for obtaining a test specimen used in a mechanical properties test in Examples.

The present invention will now be described in detail.

The present invention relates to a copper alloy for use in a member for water works, in which the content of Pb, Ni, and Bi is reduced.

In the above mentioned copper alloy, it is necessary that the content of Ni be less than 0.5% by mass. Preferably, the Ni content is less than 0.3% by mass. It is unclear as to the conditions under which Ni causes an allergy due to leaching. However, the upper limit of Ni leaching, as measured by the leaching test into water, is determined by WHO to be 0.07 mg/L or less, and there is a potential risk that this requirement may not be met, if the copper alloy contains 0.5% by mass or more of Ni. Much of the information regarding the adverse effects of Ni remains unclear, and thus, at this moment, it is considered that a lesser Ni content is more desirable.

In the above mentioned copper alloy, it is necessary that the Bi content be 0.2% by mass or more. Preferably, the Bi content is 0.3% by mass or more, more preferably, 0.4% by mass or more. Although the reduction in the physical properties of the alloy as a result of reducing the content of Pb can be compensated for by incorporating Bi, if the Bi content is less than 0.2% by mass, the reduction in the machinability cannot be ignored, and shrinkage cavities are more likely to occur in the resulting casting when subjected to sand casting. In order to reliably avoid these problems, Bi content is preferably 0.3% by mass or more. On the other hand, it is necessary that the Bi content be 0.9% by mass or less. Preferably the Bi content is 0.8% by mass or less. Since Bi is not solid-solubilized in Cu, but dispersed, a higher Bi content is more likely to cause a reduction in the tensile strength. If the Bi content exceeds 0.9% by mass, the dispersed Bi leads to a marked tendency of the alloy to develop shrinkage cavities during the sand casting, and the reduction in the tensile strength cannot be ignored.

In the above mentioned copper alloy, it is necessary that the Zn content be 12% by mass or more. Preferably, the Zn content is 13% by mass or more. A Zn content of less than 12% by mass results in a tendency to produce curled machining chips, thereby reducing the machinability. Increasing the Zn content produces an effect of reducing the Ni leaching. On the other hand, it is necessary that the Zn content be 20% by mass or less. Preferably the Zn content is 19% by mass or less, more preferably, 16% by mass or less. Too high a Zn content not only causes a reduction in mechanical properties, but also increases zinc residue, thereby complicating the casting.

In the above mentioned copper alloy, it is necessary that the Sn content be 1.5% by mass or more. Preferably, the Sn content is 2.0% by mass or more. A Sn content of less than 1.5% by mass results in a tendency to produce curled machining chips, as in the case of the Zn content, thereby reducing the machinability. On the other hand, it is necessary that the Sn content be 4.5% by mass or less. Preferably, the Sn content is 4.3% by mass or less, more preferably, 3.0% by mass or less. This is because too high a Sn content results in a reduced elongation and/or occurrence of shrinkage cavities during the sand casting.

In the above mentioned copper alloy, it is necessary that the total content of Zn and Sn be 21.5% by mass or less. Preferably, the total content is 21.0% by mass or less. If the amount of Zn solid-solubilized in Cu is too high, the solid solubility of Sn is reduced to result in an increased concentration of Sn in the residual liquid phase during the solidification. As a result, the crystallization of β-phase due to peritectic reaction is more likely to occur. Eventually, α+δ phases composed of α-phases scattered in hard δ-phases ($Cu_{31}Sn_8$) are generated between dendrites, resulting in a reduction in the tensile strength. Further, the presence of Bi dispersed in the vicinity of the α+δ phases during the generation thereof leads to a synergistic reduction in the tensile strength of the alloy. In addition, when the casting is carried out under the conditions of low solidification rate, such as when producing a thick wall casting or sand casting, there is a potential risk that the resulting casting may develop casting defects during the final solidification, such as a defect referred to as "tin sweat", a state where Sn exudes from the surface of the alloy as if it is sweating, or shrinkage cavity defects. If the total content of Zn and Sn exceeds 21.5% by mass, the reduction in mechanical properties and occurrence of casting defects cannot be ignored.

In the above mentioned copper alloy, it is necessary that the P content be 0.005% by mass or more. Preferably, the P content is 0.01% by mass or more. Since P produces a deoxidizing effect, a P content which is too low reduces the deoxidizing effect during the casting, resulting not only in an increased occurrence of gas defects, but also in a decreased flowability of molten metal due to oxidation of the molten metal. On the other hand, it is necessary that the P content be 0.1% by mass or less. Preferably, the P content is 0.05% by mass or less. If the P content is too high, P reacts with water in the mold to increase the occurrence of gas defects and shrinkage cavity defects in the resulting casting, and the mechanical properties of the resulting casting are also reduced. On the other hand, since the above mentioned copper alloy contains a high amount of Zn, gas absorption is reduced due to the degassing effect of Zn. This allows for production of a casting with little casting defects, even if the P content is low as compared to a representative bronze alloy, JIS H5120 CAC406.

The above mentioned copper alloy may contain another trace element(s), as the balance, in addition to Cu. It is necessary that the total content of the trace element(s) be within the range in which the effect of present invention is not impaired. The total content is preferably less than 1.0% by mass, more preferably, less than 0.5% by mass. This is because, if too much unexpected elements are incorporated into the alloy, even if the above mentioned elements are contained within the above mentioned ranges, there is a potential risk that the physical properties of the alloy may be deteriorated. Further, the content of one trace element is more preferably less than 0.4% by mass. Still more preferably, the content is not more than the amount contained as unavoidable impurity(ies), because the resulting alloy can be expected to have stable mechanical properties.

Among the above mentioned trace elements, the content of Pb, which is considered an impurity, is preferably less than 0.25% by mass. Pb is an element whose leaching from the alloy should be prevented as much as possible, and if the amount of Pb leaching exceeds 0.25% by mass, it will be difficult to satisfy the reference leaching value in the leaching test. The Pb content is preferably less than 0.1% by mass, and the lower the better.

Among the above mentioned trace elements, the content of each of the unavoidable impurities, which are unavoidably incorporated into the alloy due to the problems associated with the raw materials or the production process, is preferably less than 0.4% by mass, more preferably, less than 0.2% by mass, and still more preferably, less than the detection limit. Examples of such impurities include Fe, Mn, Cr, Zr, Mg, Ti, Te, Se, Cd, Si, Al, and Sb. Among those in particular, the content of Se and Cd, which are known to be toxic, is each preferably less than 0.1% by mass, more preferably, less than the detection limit.

Among the above mentioned unavoidable impurities, the content of Si is preferably less than 0.01% by mass, more preferably, less than 0.005% by mass. A Si content that is too high tends to increase the occurrence of shrinkage cavities, resulting in a failure to produce a decent casting.

Among the above mentioned unavoidable impurities, the content of Al is preferably less than 0.01% by mass, more preferably, less than 0.005% by mass. An Al content that is too high, as with the Si content, tends to increase the occurrence of shrinkage cavities, resulting in a failure to produce a decent casting.

Among the above mentioned unavoidable impurities, the content of Sb is preferably less than 0.05% by mass, more preferably, less than 0.03% by mass, and most preferably, less than the detection limit. Since Sb tends to form Cu—Sn—Sb-based intermetallic compounds which tend to reduce the toughness of the alloy, there is a risk that the mechanical properties of the alloy may be reduced.

On the other hand, if the alloy contains 0.0003% by mass or more of B, as one of the above mentioned trace elements, the flowability of molten metal during the casting can be improved. Preferably, the B content is 0.0005% by mass or more, since the flowability of molten metal can further be improved. On the other hand, a B content of more than 0.006% by mass leads to a sharp drop in the tensile strength, and an increased occurrence of shrinkage cavities. Therefore, the B content is preferably 0.006% by mass or less. Further, if the B content is 0.003% by mass or less, the flowability of molten metal can be improved, without causing deterioration of the mechanical properties and/or occurrence of casting defects.

Note that, the values of the content of the elements as described in the present invention denote the values of the content of elements in the resulting casting or forging, not the content thereof in the raw materials.

The balance (remainder) of the above mentioned copper alloy is Cu. The copper alloy according to the present invention can be produced by a common method for producing a copper alloy. When producing a member for water works using the thus obtained copper alloy, a common casting method (such as sand casting) can be used. For example, a member for water works can be prepared by a method in which an alloy is melted using an oil furnace, gas furnace, or high frequency induction melting furnace, and then cast using molds in various shapes.

EXAMPLES

Examples in which the copper alloy of the present invention was actually produced will now be described. Firstly, the testing methods for copper alloy will be described.

<Mechanical Properties Test>

For each of the alloys, a Type A sample defined in JIS H5120 and having the shape as shown in FIG. 1 was prepared by casting. Then the shaded portion of the sample shown in FIG. 1 was cut out from the sample, and subjected to machining to produce a Type 4 test specimen (diameter: $d_0$=14 mm, original gauge length: $L_0$=50 mm, length of the parallel portion: $L_c$=60 mm, radius of the shoulder portion: R=15 mm or more) defined in JIS Z2241 Annex D and having the shape shown in FIG. 2. The tensile strength and elongation for each of the test specimens were then measured. Specifically, the measurement was carried out as follows. As the tensile strength, the stress (MPa) corresponding to the maximum test force the test specimen withstood without exhibiting discontinuous yielding was measured. The elongation is the value of the permanent elongation: $(L_u-L_0)$ of the test specimen, which is the increment from the original gauge length: $L_0$ to the gauge length at break: $L_u$, expressed in percentage with respect to $L_0$. In other words, the elongation=$\{(L_u-L_0)/L_0\}\times100(\%)$. This is the value in accordance with JIS Z2241. The mechanical properties of each of the test specimens were evaluated based on the thus obtained values.

The tensile strength was evaluated as follows: "○" . . . 195 MPa or more; and "x" . . . less than 195 MPa.

The elongation was evaluated as follows: "○" . . . 15% or more; and "x" . . . less than 15%.

Note that, these threshold values are reference values for JIS H5120 CAC406 generally used in a member for water works.

<Machinability Test>

The evaluations for the drilling test and the lathe machining test as described below were combined to determine the overall evaluation of the machinability. The overall evaluation of the machinability was carried out according to the following standards: those evaluated as "◎" in the drilling test and evaluated as "○" in the lathe machining test were defined as "◎"; those evaluated as "○" in both the drilling test and the lathe machining test were defined as "○"; those having at least one "Δ" evaluation were defined as "Δ"; and those having at least one "x" evaluation were defined as "x".

<Machinability Test/Drilling Test>

For each of the alloys, the drilling test using a drilling machine was carried out. The drilling test was carried out using each of the samples formed by machining to a size of 20 mm diameter×10H (mm height), and using a drilling machine, under the conditions as shown in Table 1. Evaluation was carried out as follows. The time required to drill a 5 mm hole in each of the samples was measured, and those with the results of 5 seconds or less were evaluated as "◎"; those with the results of more than 5 seconds and 10 seconds or less are evaluated as "○"; those with the results of more than 10 seconds and 15 seconds or less are evaluated as "Δ"; and those with results exceeding 15 seconds are evaluated as "x".

TABLE 1

| Item | | Conditions |
|---|---|---|
| Cutting tool (SDD0600; manufactured by Mitsubishi) | Material | High-speed steel |
| | Cutting diameter | Diameter: 6 mm |
| | Total length | 102 mm |
| | Flute length | 70 mm |
| | Point angle | 118 degrees |
| Load | | 25 kg |
| Rotational speed | | 960 rpm |
| Drilling depth | | 5 mm |

<Machinability Test/Lathe Machining Test>

Figures 2, 3:
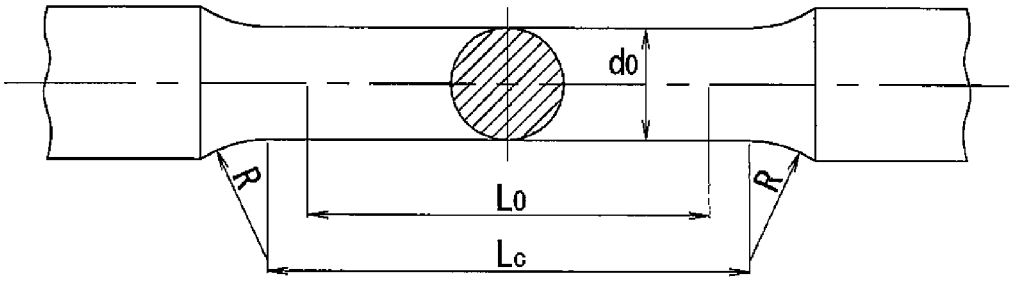
FIG. 2 is a structural view of the test specimen used in the mechanical properties test in Examples.
FIG. 3 shows the reference for evaluation and categorization of machining chips, to be used in a machinability test in Examples.

For each of the alloys, the shape of machining chips, which were obtained when the alloy was subjected to lathe machining to produce the test specimen for the tensile test, was examined to evaluate the machinability. The lathe machining was carried out under the following conditions: the tool used: high-speed steel; rotational speed: 700 rpm, cut depth: 2 mm, and feed rate: 0.07 mm/rev. Then machining chips produced were collected, and categorized based on their shapes, as shown in FIG. 3. The evaluation was carried out as follows: those falling within the category of "Good" were evaluated as (○), and those falling within the category of "Poor" were evaluated as (x).

<Test for Flowability of Molten Metal>

Figure 4:
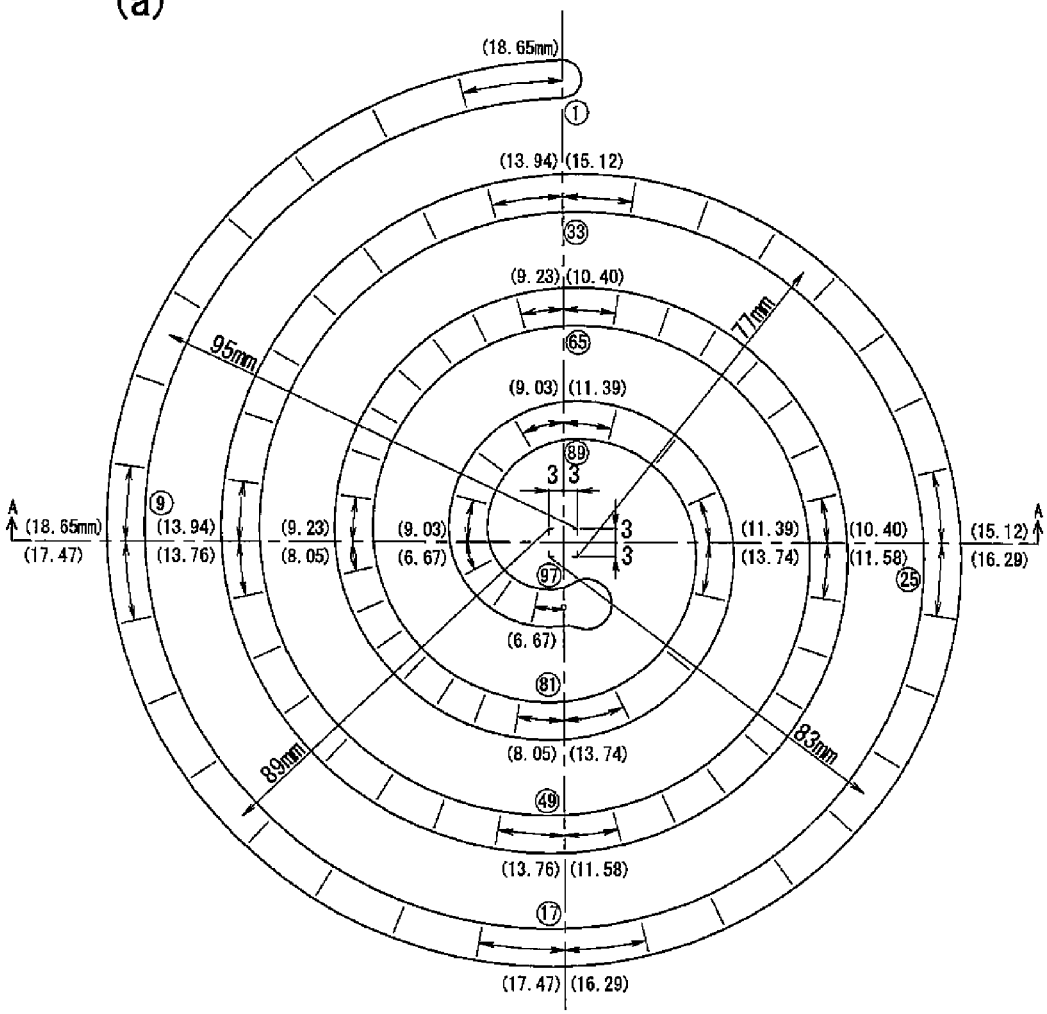
FIG. 4 is a view illustrating a spiral-shaped test mold used in a test for flowability of molten metal in Examples.
Figure 4:
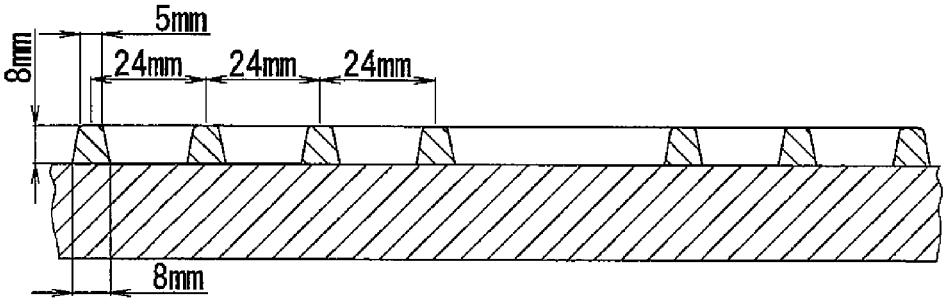

Each of the copper alloys of Examples and Comparative Examples was heated and melted, and then cast using a spiral-shaped test mold shown in FIG. 4 to obtain a spiral-shaped test specimen. Since each of the alloys varying in its Zn content has a different temperature at which solidification starts, it is impossible to evaluate the proper flowability of molten metal for each of the alloys using the same pouring temperature. Therefore, the temperature at which the solidification starts was measured for each of the alloys by thermal analysis method, and then the casting was carried out at a temperature 140° C. above the measured temperature. Then, the flow length of the spiral-shaped portion of the thus cast spiral-shaped test specimen was measured. The flow length was evaluated based on the spiral-shaped test specimen (298 mm) made of the alloy of Comparative Example 11 to be described later as a reference material, which is an alloy of JIS H5120 CAC406. Those having the same as or longer than the length of the reference material were evaluated as (○); and those having the length less than the length of the reference material were evaluated as (x).

<Test for Casting Defects>

<Liquid Penetrant Test Using Step-Shaped Sample>

Figure 5:
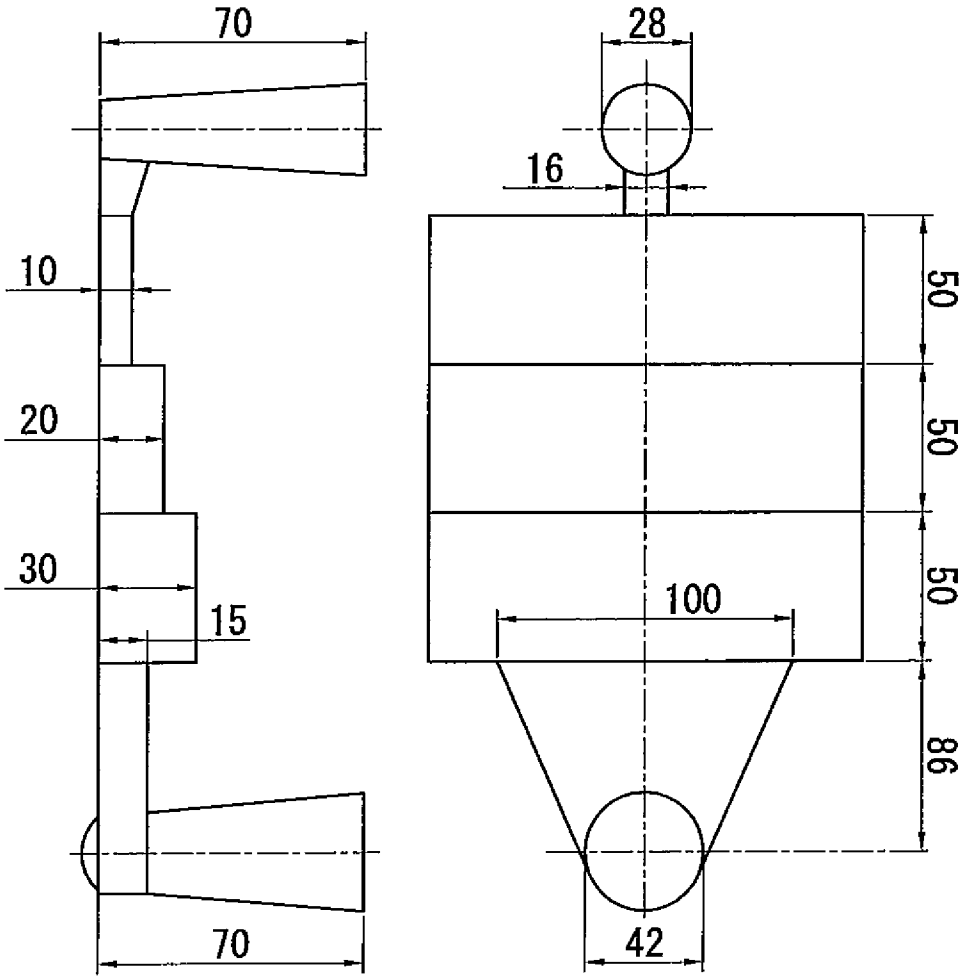
FIG. 5 is a structural view of a step-shaped mold used in a shrinkage cavity test in Examples.

For each of the alloys, liquid penetrant test was performed using a step-shaped sample, and evaluation of casting defects was performed. "-" in the Table denotes that the evaluation was not carried out. Specifically, the test was carried out as follows. A step-shaped $CO_2$ mold as shown in FIG. 5 was prepared, and the mold was provided with three stepped portions with varying wall thicknesses of 10, 20 and 30 mm, so that the feeding effect is reduced and the resulting casting is more likely to develop casting defects. Each of the alloys was cast using the step-shaped mold, the obtained casting was cut in half in the middle, and the liquid penetrant test was carried out in accordance with JIS Z2343. Specifically, the liquid penetrant test was carried out using: a removing liquid, FR-Q, manufactured by Taseto Co., Ltd.; a penetrant, FP-S; and a quick drying developer, FD-S; and according to the following procedure: the cut plane of the step-shaped sample was: (1) washed using the removing liquid; (2) coated with the penetrant and allowed to absorb the penetrant for 10 minutes; (3) cleaned with a cloth impregnated with the removing liquid to remove the penetrant; (4) sprayed with the quick drying developer; and (5) dried; and thereafter, occurrence of casting defects and minute gaps were examined. Evaluation was carried out based on the following standards: those in which indications such as shrinkage cavity defects and/or gas defects were not observed on the cut plane, and no tin sweat was observed based on the appearance observation of the sample, and which can be produced with the same casting method as the alloy of JIS H5120 CAC406, which is the reference material, were defined as (o); and those in which some indications were observed in the central region of the stepped portions in the thickness direction, and/or some tin sweat was observed, but which can be produced with the same casting method as the alloy of JIS H5120 CAC406, were defined as "pass" (Δ). However, for those defined as (Δ), the production method and the like require consideration, because there is a potential risk that defects could occur depending on the shape of the casting or the casting conditions. Further, those having the results other than the above mentioned results were defined as (x).

<Production Method>

Materials containing each of the elements were mixed, and melted in a high frequency induction melting furnace, followed by casting using a $CO_2$ mold to produce samples each having the composition as shown in Table 2. All the values of the content of the elements are expressed in % by mass, and are values measured in the resulting casting after the production. A conventionally used bronze material containing lead, JIS H5120 CAC406, was used as Comparative Example 11, which was used as a reference material for the comparison of physical properties. The content of each of the elements in Comparative Example 11 is also shown in the Table. The following tests were carried out for each of the resulting copper alloys. Note that, the content of each of Sb, Al, Si, and Fe was less than the detection limit, in each of Examples and Comparative Examples shown the Table 2. The content of "0" in the Table means that the content is less than the detection limit. The overall evaluation was carried out according to the following standards: those having "◎" or "○" evaluation in all the tests performed were defined as "○"; those having as least one "Δ" evaluation in any of the tests were defined as "Δ"; and those having as least one "x" evaluation in any of the tests were defined as "x".

TABLE 2

| | Cu Balance | Zn 12.0 to 20.0 | Sn 1.5 to 4.5 | Zn + Sn ≤21.5 | P 0.005 to 0.1 | Bi 0.2 to 0.9 | B 0 to 0.006 | Ni Less than 0.5 | Pb Less than 0.25 | Sb 0.05 or less | Al 0.01 or less | Si 0.01 or less | Fe 0.3 or less |
|---|---|---|---|---|---|---|---|---|---|---|---|---|---|
| Comparative Example 1 | Balance | 10.66 | 2.31 | 12.97 | 0.015 | 0.49 | 0 | 0.00051 | 0 | 0 | 0 | 0 | 0 |
| Example 1 | Balance | 12.51 | 2.42 | 14.93 | 0.014 | 0.50 | 0 | <0.0005 | 0 | 0 | 0 | 0 | 0 |
| Example 2 | Balance | 16.43 | 2.41 | 18.84 | 0.027 | 0.56 | 0 | <0.0005 | 0 | 0 | 0 | 0 | 0 |
| Example 3 | Balance | 18.70 | 2.42 | 21.12 | 0.014 | 0.51 | 0 | <0.0005 | 0 | 0 | 0 | 0 | 0 |
| Example 4 | Balance | 19.08 | 1.83 | 20.91 | 0.015 | 0.47 | 0 | 0.0029 | 0 | 0 | 0 | 0 | 0 |
| Comparative Example 2 | Balance | 16.04 | 0.96 | 17.00 | 0.019 | 0.48 | 0 | <0.0005 | 0 | 0 | 0 | 0 | 0 |
| Example 5 | Balance | 15.43 | 1.58 | 17.01 | 0.015 | 0.49 | 0 | <0.0005 | 0 | 0 | 0 | 0 | 0 |
| Example 2 | Balance | 16.43 | 2.41 | 18.84 | 0.027 | 0.56 | 0 | <0.0005 | 0 | 0 | 0 | 0 | 0 |
| Example 6 | Balance | 15.18 | 2.95 | 18.13 | 0.013 | 0.52 | 0 | 0.0022 | 0 | 0 | 0 | 0 | 0 |
| Example 7 | Balance | 15.58 | 3.46 | 19.04 | 0.016 | 0.54 | 0 | <0.0005 | 0 | 0 | 0 | 0 | 0 |
| Example 8 | Balance | 16.05 | 3.93 | 19.98 | 0.020 | 0.52 | 0 | 0.00051 | 0 | 0 | 0 | 0 | 0 |
| Example 5 | Balance | 15.43 | 1.58 | 17.01 | 0.015 | 0.49 | 0 | <0.0005 | 0 | 0 | 0 | 0 | 0 |
| Example 2 | Balance | 16.43 | 2.41 | 18.84 | 0.027 | 0.56 | 0 | <0.0005 | 0 | 0 | 0 | 0 | 0 |
| Example 3 | Balance | 18.70 | 2.42 | 21.12 | 0.014 | 0.51 | 0 | <0.0005 | 0 | 0 | 0 | 0 | 0 |
| Comparative Example 3 | Balance | 18.97 | 3.40 | 22.37 | 0.016 | 0.53 | 0 | 0.00057 | 0 | 0 | 0 | 0 | 0 |
| Comparative Example 4 | Balance | 16.25 | 2.39 | 18.64 | 0.003 | 0.49 | 0 | 0.00055 | 0 | 0 | 0 | 0 | 0 |
| Example 9 | Balance | 15.60 | 2.47 | 18.07 | 0.006 | 0.49 | 0 | <0.0005 | 0 | 0 | 0 | 0 | 0 |
| Example 10 | Balance | 15.56 | 2.49 | 18.05 | 0.013 | 0.50 | 0 | <0.0006 | 0 | 0 | 0 | 0 | 0 |
| Example 2 | Balance | 16.43 | 2.41 | 18.84 | 0.027 | 0.56 | 0 | <0.0005 | 0 | 0 | 0 | 0 | 0 |
| Example 11 | Balance | 15.43 | 2.48 | 17.91 | 0.058 | 0.50 | 0 | <0.0005 | 0 | 0 | 0 | 0 | 0 |
| Example 12 | Balance | 16.27 | 2.49 | 18.76 | 0.100 | 0.50 | 0 | <0.0005 | 0 | 0 | 0 | 0 | 0 |
| Comparative Example 5 | Balance | 15.38 | 2.40 | 17.78 | 0.215 | 0.49 | 0 | <0.0005 | 0 | 0 | 0 | 0 | 0 |
| Comparative Example 6 | Balance | 16.10 | 2.54 | 18.64 | 0.014 | 0.04 | 0 | <0.0005 | 0 | 0 | 0 | 0 | 0 |
| Example 13 | Balance | 16.56 | 2.40 | 18.96 | 0.028 | 0.20 | 0 | <0.0005 | 0 | 0 | 0 | 0 | 0 |
| Example 2 | Balance | 16.43 | 2.41 | 18.84 | 0.027 | 0.56 | 0 | <0.0005 | 0 | 0 | 0 | 0 | 0 |
| Example 14 | Balance | 15.18 | 2.95 | 18.13 | 0.013 | 0.52 | 0 | 0.0022 | 0 | 0 | 0 | 0 | 0 |
| Example 15 | Balance | 15.46 | 2.46 | 17.92 | 0.011 | 0.80 | 0 | <0.0005 | 0 | 0 | 0 | 0 | 0 |
| Comparative Example 7 | Balance | 17.29 | 3.01 | 20.30 | 0.019 | 1.05 | 0 | 0.00052 | 0 | 0 | 0 | 0 | 0 |
| Comparative Example 8 | Balance | 15.61 | 2.19 | 17.80 | 0.032 | 1.59 | 0 | <0.0005 | 0 | 0 | 0 | 0 | 0 |
| Comparative Example 9 | Balance | 15.55 | 2.35 | 17.90 | 0.023 | 2.50 | 0 | <0.0005 | 0 | 0 | 0 | 0 | 0 |
| Example 16 | Balance | 15.37 | 2.38 | 17.75 | 0.011 | 0.49 | 0.00046 | 0.003 | 0 | 0 | 0 | 0 | 0 |
| Example 17 | Balance | 15.74 | 2.45 | 18.19 | 0.022 | 0.53 | 0.00220 | 0.019 | 0 | 0 | 0 | 0 | 0 |
| Example 18 | Balance | 15.43 | 2.41 | 17.84 | 0.014 | 0.49 | 0.00520 | 0.047 | 0 | 0 | 0 | 0 | 0 |
| Comparative Example 10 | Balance | 15.24 | 2.44 | 17.68 | 0.014 | 0.51 | 0.01130 | 0.095 | 0 | 0 | 0 | 0 | 0 |
| Example 19 | Balance | 15.59 | 2.44 | 18.03 | 0.018 | 0.49 | 0 | 0.11 | 0 | 0 | 0 | 0 | 0 |
| Example 20 | Balance | 15.49 | 2.61 | 18.10 | 0.014 | 0.56 | 0 | 0.21 | 0 | 0 | 0 | 0 | 0 |
| Example 21 | Balance | 14.90 | 2.15 | 17.05 | 0.010 | 0.48 | 0 | 0.25 | 0 | 0 | 0 | 0 | 0 |
| Example 22 | Balance | 15.42 | 2.42 | 17.84 | 0.013 | 0.50 | 0 | 0.45 | 0 | 0 | 0 | 0 | 0 |
| Comparative Example 11 | Balance | 5.14 | 5.78 | 10.92 | 0.021 | 0.0 | 0 | 0.15 | 5.38 | | | | |

| | Mechanical Properties | | | | Machinability | | | Flowability of molten metal | | Casting defects | | |
|---|---|---|---|---|---|---|---|---|---|---|---|---|
| | Tensile strength 195 MPa or more | | Elongation 15% or more | | Drilling test 15 sec or lower | Lathe machining chips | Overall evaluation of machinability | Evaluation of flowability of molten metal | Flow length mm | Evaluation of defects | Type of defects | Overall Evaluation |
| Comparative Example 1 | ○ | 253 | ○ | 54.1 | ○ | 05 sec 14 | X | X | ○ | 410 | ○ | X |
| Example 1 | ○ | 246 | ○ | 55.3 | ○ | 05 sec 39 | ○ | ○ | ○ | 376 | ○ | ○ |
| Example 2 | ○ | 208 | ○ | 29.2 | ○ | 05 sec 46 | ○ | ○ | ○ | 366 | ○ | ○ |

TABLE 2-continued

| | | | | | | | | | | | | | |
|---|---|---|---|---|---|---|---|---|---|---|---|---|---|
| Example 3 | ○ | 202 | ○ | 29.6 | ○ | 06 sec 63 | ○ | ○ | ○ | 325 | — | | ○ |
| Example 4 | ○ | 237 | ○ | 50.1 | ○ | 07 sec 13 | ○ | ○ | ○ | 345 | ○ | | ○ |
| Comparative Example 2 | ○ | 228 | ○ | 54.6 | ○ | 06 sec 94 | X | X | ○ | 378 | ○ | | X |
| Example 5 | ○ | 252 | ○ | 47.2 | ○ | 05 sec 50 | ○ | ○ | ○ | 356 | ○ | | ○ |
| Example 2 | ○ | 208 | ○ | 29.2 | ○ | 05 sec 46 | ○ | ○ | ○ | 366 | ○ | | ○ |
| Example 6 | ○ | 242 | ○ | 41.8 | ○ | 07 sec 10 | ○ | ○ | — | — | — | | ○ |
| Example 7 | ○ | 197 | ○ | 22.7 | ○ | 06 sec 76 | ○ | ○ | — | — | — | | ○ |
| Example 8 | ○ | 233 | ○ | 32.7 | ○ | 07 sec 97 | ○ | ○ | ○ | 372 | ○ | | ○ |
| Example 5 | ○ | 252 | ○ | 47.2 | ○ | 05 sec 50 | ○ | ○ | ○ | 356 | ○ | | ○ |
| Example 2 | ○ | 208 | ○ | 29.2 | ○ | 05 sec 46 | ○ | ○ | ○ | 366 | ○ | | ○ |
| Example 3 | ○ | 202 | ○ | 29.6 | ○ | 06 sec 63 | ○ | ○ | ○ | 325 | — | | ○ |
| Comparative Example 3 | X | 177 | ○ | 20.7 | ○ | 06 sec 45 | ○ | ○ | ○ | 405 | X | Gas/tin sweat | X |
| Comparative Example 4 | ○ | 227 | ○ | 38.2 | ○ | 06 sec 77 | ○ | ○ | X | 287 | Δ | shrinkage cavity | X |
| Example 9 | ○ | 216 | ○ | 30.8 | ○ | 06 sec 12 | ○ | ○ | ○ | 343 | ○ | | ○ |
| Example 10 | ○ | 244 | ○ | 49.2 | ○ | 06 sec 45 | ○ | ○ | — | — | — | | ○ |
| Example 2 | ○ | 208 | ○ | 29.2 | ○ | 05 sec 46 | ○ | ○ | ○ | 366 | ○ | | ○ |
| Example 11 | ○ | 243 | ○ | 45.5 | ○ | 06 sec 71 | ○ | ○ | — | — | — | | ○ |
| Example 12 | ○ | 227 | ○ | 35.9 | ○ | 07 sec 17 | ○ | ○ | ○ | 398 | ○ | | ○ |
| Comparative Example 5 | ○ | 200 | ○ | 24.5 | ○ | 06 sec 38 | ○ | ○ | ○ | 352 | X | Gas/shrinkage cavity/tin sweat | X |
| Comparative Example 6 | ○ | 250 | ○ | 53.6 | X | 19 sec 42 | X | X | ○ | 363 | X | shrinkage cavity | X |
| Example 13 | ○ | 231 | ○ | 37.4 | Δ | 13 sec 53 | ○ | Δ | ○ | 312 | ○ | | Δ |
| Example 2 | ○ | 208 | ○ | 29.2 | ○ | 05 sec 46 | ○ | ○ | ○ | 366 | ○ | | ○ |
| Example 14 | ○ | 242 | ○ | 41.8 | ○ | 07 sec 10 | ○ | ○ | — | — | — | | ○ |
| Example 15 | ○ | 225 | ○ | 40.5 | ◎ | 04 sec 49 | ○ | ◎ | ○ | 372 | ○ | | ○ |
| Comparative Example 7 | X | 173 | ○ | 19.3 | ◎ | 03 sec 81 | ○ | ◎ | ○ | 338 | X | Gas/shrinkage cavity | X |
| Comparative Example 8 | X | 184 | ○ | 21.8 | — | — | — | — | — | — | X | Gas | X |
| Comparative Example 9 | X | 164 | X | 13.3 | — | — | — | — | — | — | X | Gas/shrinkage cavity | X |
| Example 16 | ○ | 243 | ○ | 56.3 | ○ | 06 sec 87 | ○ | ○ | ○ | 424 | ○ | | ○ |
| Example 17 | ○ | 215 | ○ | 29.5 | ○ | 05 sec 68 | ○ | ○ | ○ | 433 | — | | ○ |
| Example 18 | ○ | 216 | ○ | 33.6 | ○ | 06 sec 41 | ○ | ○ | ○ | 452 | ○ | | ○ |

TABLE 2-continued

| | | | | | | | | | | | | | |
|---|---|---|---|---|---|---|---|---|---|---|---|---|---|
| Comparative Example 10 | X | 171 | ○ | 17.5 | ○ | 06 sec 71 | ○ | ○ | ○ | 449 | X | Gas/shrinkage cavity | X |
| Example 19 | ○ | 251 | ○ | 51.0 | — | — | — | — | — | — | — | | ○ |
| Example 20 | ○ | 248 | ○ | 53.4 | — | — | — | — | — | — | — | | ○ |
| Example 21 | ○ | 244 | ○ | 49.2 | — | — | — | — | — | — | — | | ○ |
| Example 22 | ○ | 249 | ○ | 55.5 | — | — | — | — | — | — | — | | ○ |
| Comparative Example 11 | ○ | 250 | ○ | 33.2 | ◎ | 02 sec 15 | ○ | ◎ | Reference | 298 | Reference | | Pb leaching X |

Figure 7:
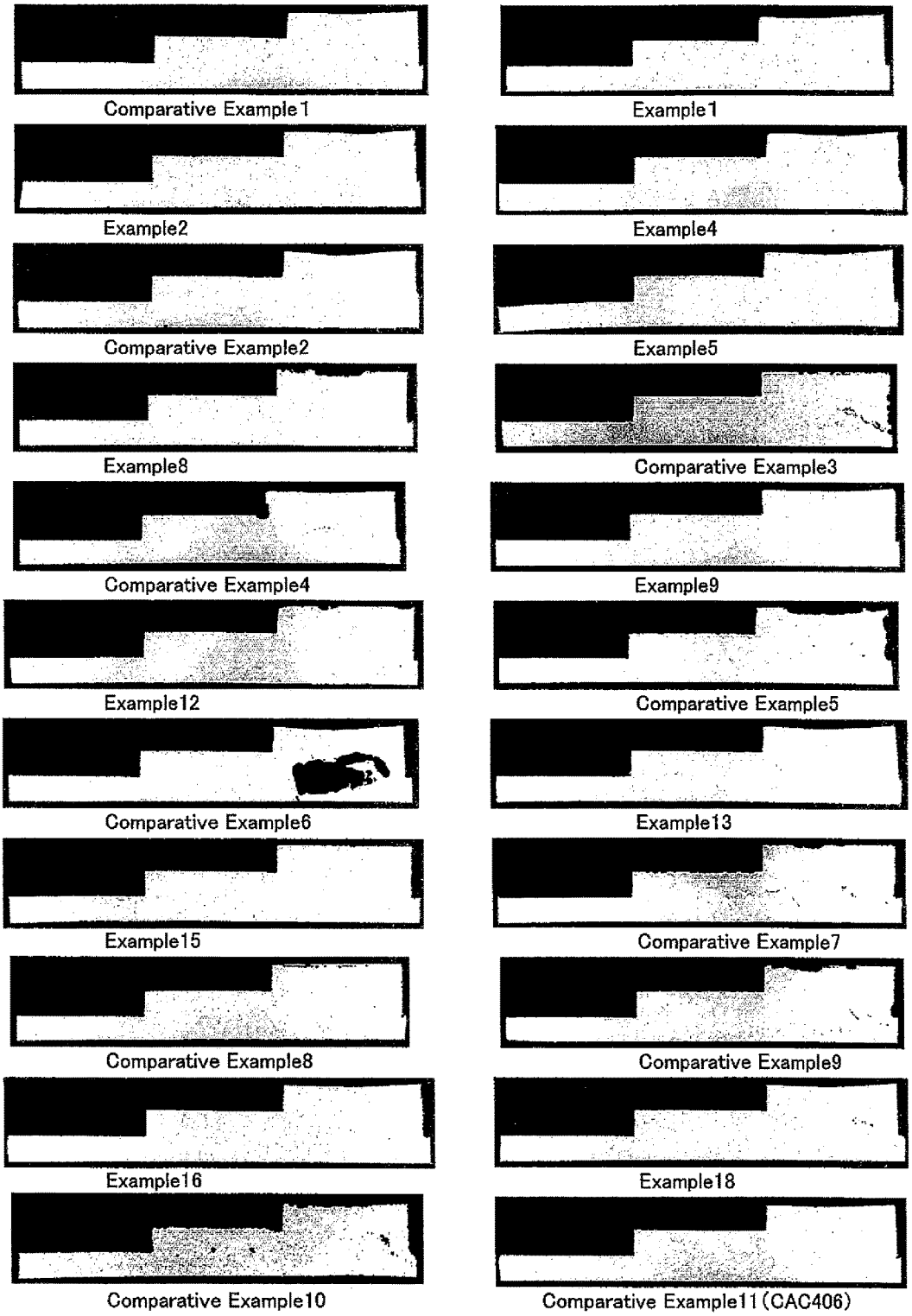
FIG. 7 shows photographs illustrating the results of a liquid penetrant test carried out in Examples and Comparative Examples (no. 1).
Figure 10:
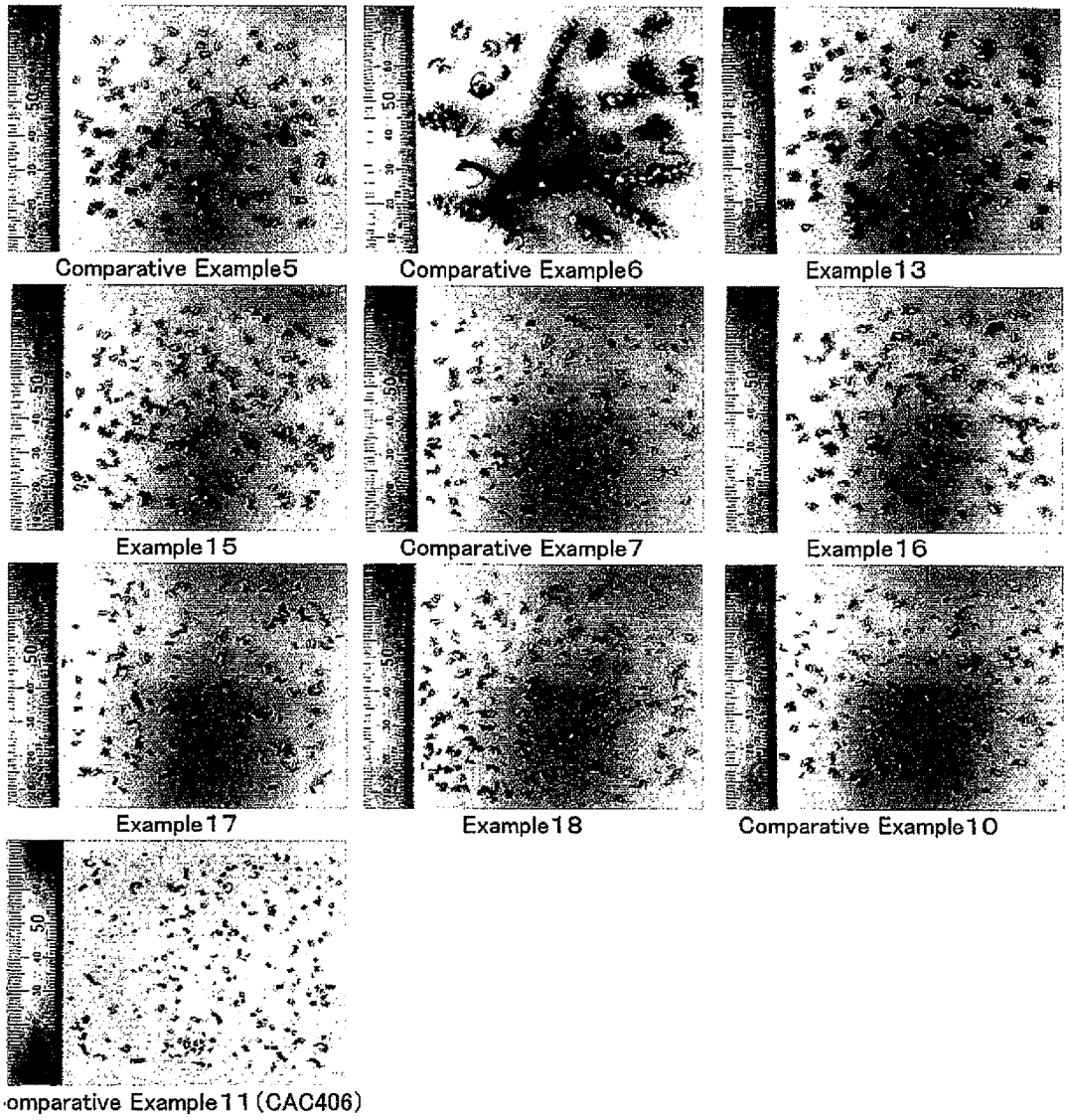
FIG. 10 shows photographs illustrating the results of the machining test carried out in Examples and Comparative Examples.

First, the alloy CAC406 used as the reference material, which is shown in Table 2 as Comparative Example 11, will be described. The alloy CAC406 has mechanical properties such as a tensile strength of 195 MPa or more, and an elongation of 15% or more, as specified in JIS. Since CAC406 contains 5.38% by mass of Pb, Comparative Example 11 exhibited good machinability as shown in Table 2 and FIG. 10, with good evaluations in both the drilling test and the lathe machining test. Further, the flow length measured in the test for flowability of molten metal was 298 mm, as shown in Table 2, and this value was used as the reference value for the comparison of the flow length of each of the alloys. In the test using the step-shaped sample, as shown in FIG. 7, no indication was observed in each of the portions having different thicknesses, providing good results. On the other hand, since from 4% to 6% by mass of Pb is contained, Comparative Example 11 has a problem in lead leaching.

Figure 6:
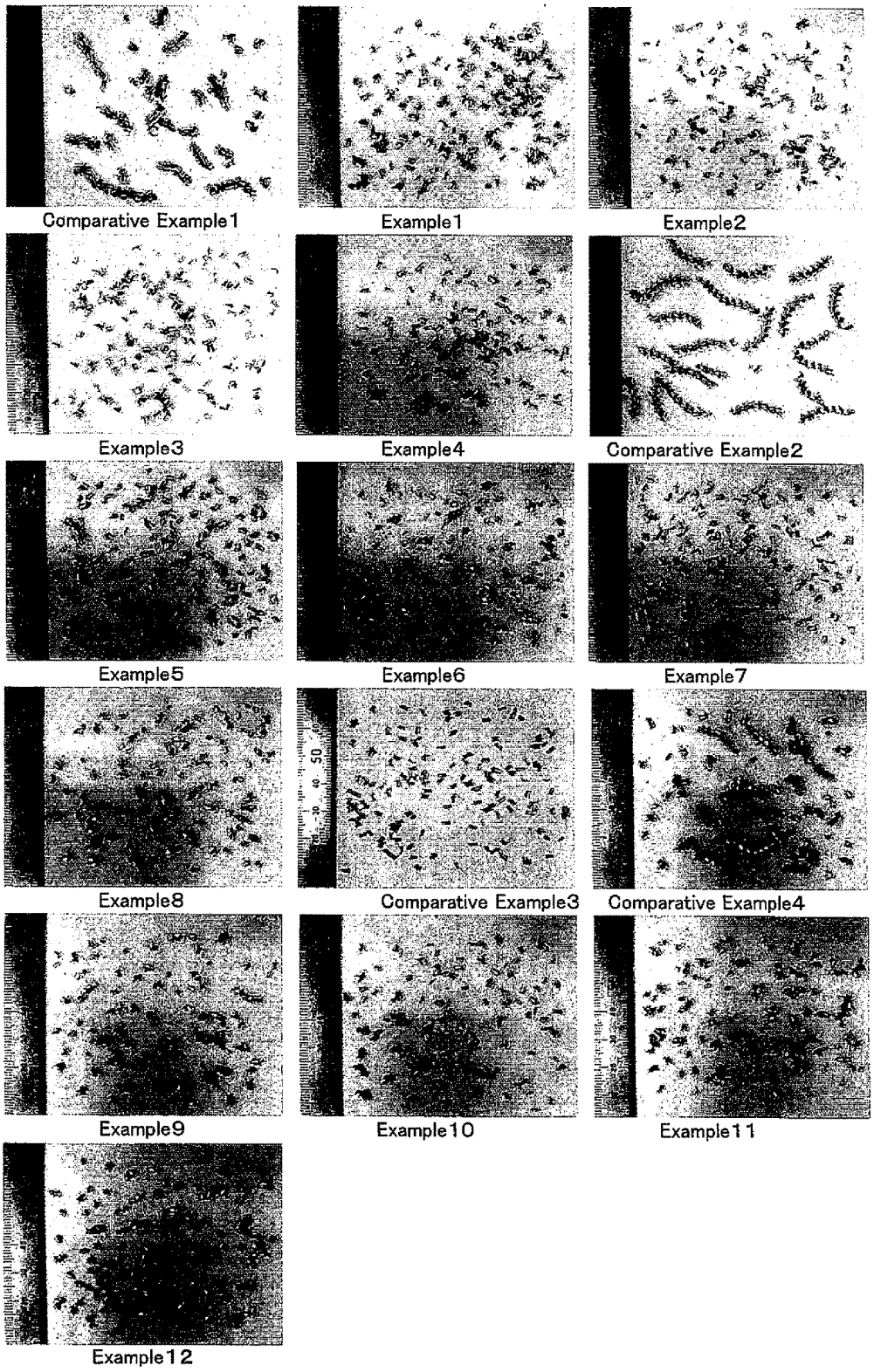
FIG. 6 shows photographs of machining chips obtained in a machining test carried out in Examples and Comparative Examples.

Next, Comparative Example 1 and Examples 1 to 4 shown in the first group in Table 2 will be described. These alloys were prepared to have a varying Zn content, with the contents of other elements being as close to each other as possible. The results for the machinability test are shown in Table 2 and FIG. 6. Comparative Example 1 and Examples 1 to 4 showed good results in the drilling test, each exhibiting short drilling time. However, in the lathe machining test, Comparative Example 1 having a Zn content of 10.66% by mass, which is less than 12.0% by mass, produced cylindrical machining chips, resulting in a poor overall machinability. On the other hand, Examples 1 to 4 having the Zn content satisfying the range condition showed good results in the lathe machining test, each producing sheared machining chips. In addition, the results for the casting defect test are shown in FIG. 7, except for Example 3. No shrinkage cavity or the like was observed in each of the alloys, and good results were obtained.

Next, Comparative Example 2, and Examples 2 and 5 to 8 shown in the second group in the Table 2 will be described. These alloys were prepared to have a varying Sn content with Example 2 having roughly an intermediate value, and with the contents of other elements being as close to each other as possible, and they are arranged in the order based on the Sn content. As with the above-discussed results, the results for the machinability test are shown in Table 2 and FIG. 6; and the results for the casting defect test are shown in FIG. 7, except for Examples 6 and 7. Comparative Example 2, and Examples 2 and 5 to 8 showed good results in the drilling test, each exhibiting short drilling time. However, in the lathe machining test, Comparative Example 2 having a Sn content of 0.96% by mass, which is less than 1.5% by mass, produced cylindrical machining chips, resulting in a poor overall machinability. On the other hand, Examples 2 and 5 to 8 showed good results in the lathe machining test, each producing sheared machining chips. Further, Comparative Example 2, and Examples 2, 5 and 8 showed good results in the casting defect test, with no detectable shrinkage cavity or the like being observed. Note that, the indication observed at the upper portion of the 30 mm-thick portion of the step-shaped sample of Example 8 is a region which was colored due to the penetrant remaining on the surfaces of the sample other than the surface to be observed, and it is unrelated to casting defects.

Figure 8:
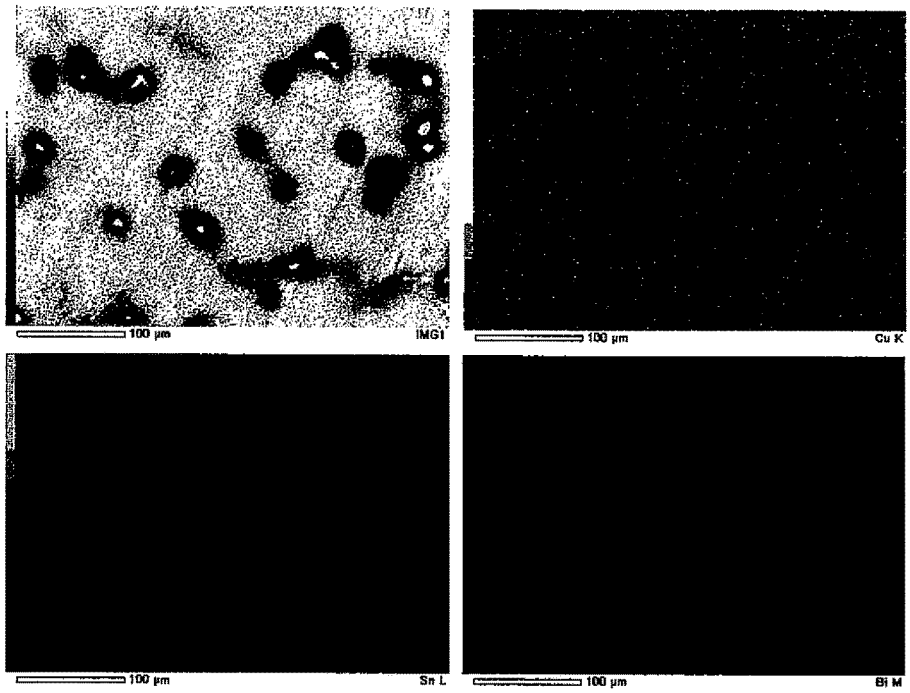
FIG. 8 shows photographs illustrating the changes in the texture of alloys of Examples 2 and 5, associated with the changes in the total content of Zn and Sn.
Figure 8:
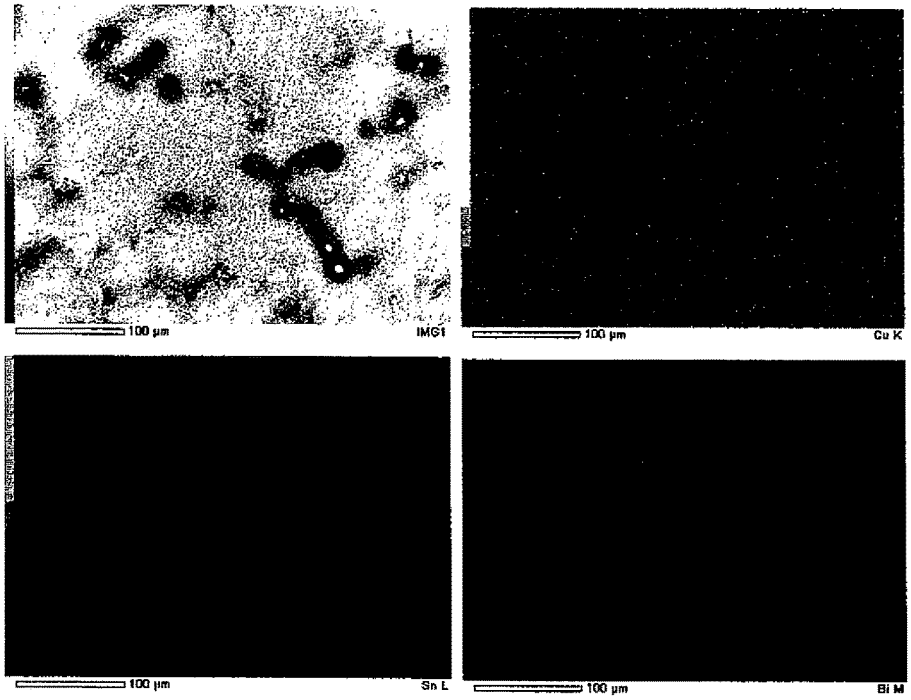
Figure 9:
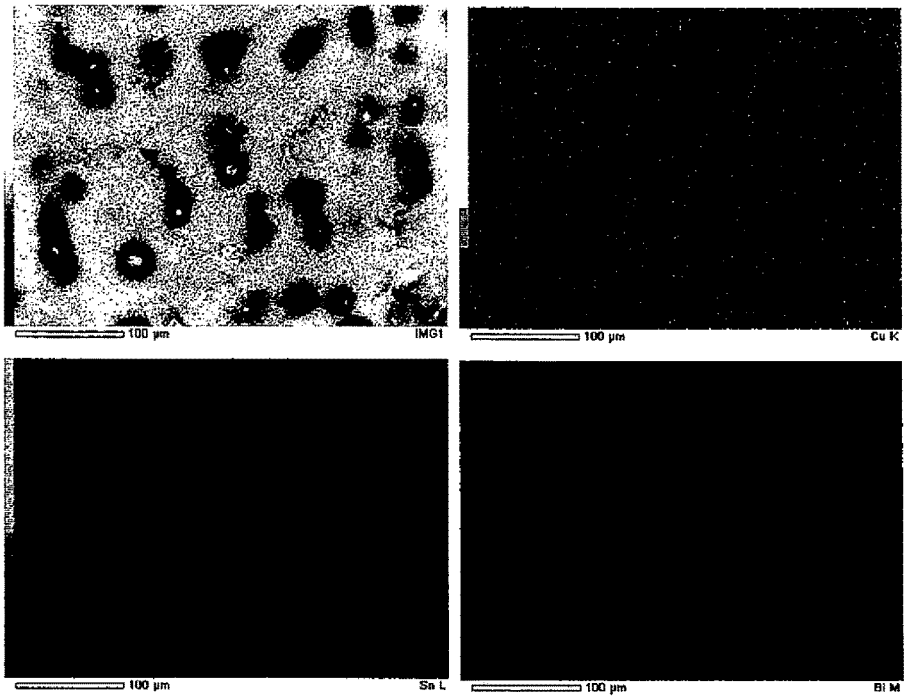
FIG. 9 shows photographs illustrating the changes in the texture of alloys of Example 3 and Comparative Example 3, associated with the changes in the total content of Zn and Sn.
Figure 9:
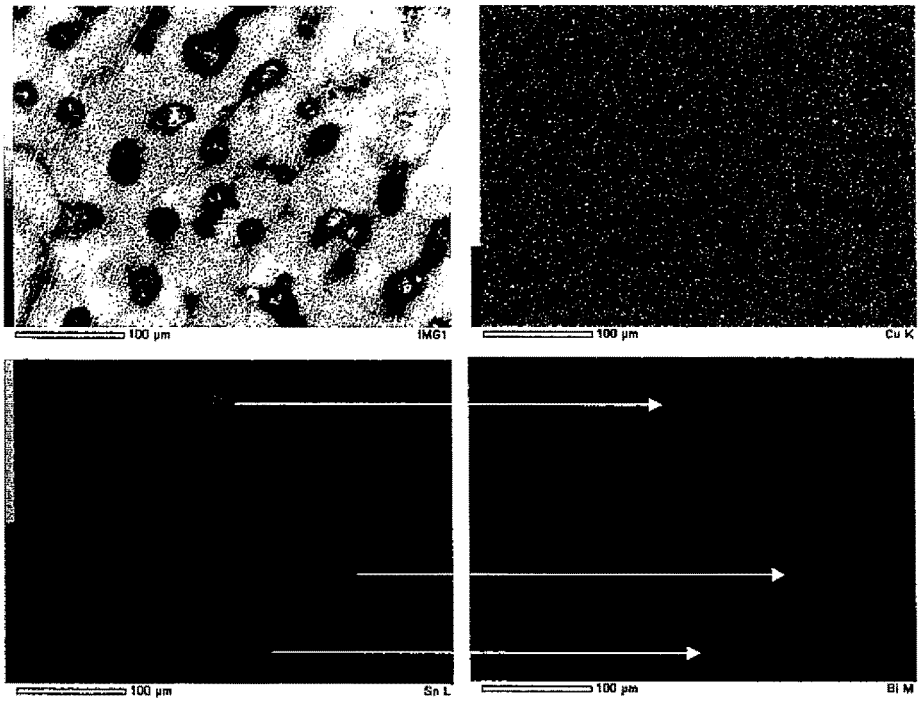

Next, Example 5, Example 2, Example 3, and Comparative Example 3 shown in the third group in Table 2 will be described, which are arranged in the order based on the total content of Zn and Sn. Since in the alloy of Comparative Example 3 the total content of Zn and Sn is 22.37% by mass, which is greater than 21.5% by mass, there was a problem in the tensile strength, despite good machinability. This is considered to be due to excessive $\alpha+\delta$ phases being generated in the alloy, combined with the synergetic adverse effect of Bi, causing a decrease in the tensile strength. To investigate these effects metallographically, texture observation and elemental analysis were carried out by SEM-EDS analysis, using JSM-7000, manufactured by JEOL Ltd. The results of both analyses are shown in FIGS. 8 (*a*) and (*b*), and FIGS. 9 (*a*) and (*b*). In each of the figures, the image shown on the upper left is a SEM image, one on the upper right is the result for Cu, one on the lower left is the result for Sn, and one on the lower right is the result for Bi. It can be seen from the results of Example 5, Example 2, and Example 3, that the $\delta$ phase with a high Sn concentration is either not generated or generated only in a minute amount and finely dispersed. On the other hand, in the alloy of Comparative Example 3 shown in FIG. 9 (*d*), large $\delta$ phases having a high Sn concentration were observed, which are shown as lighter portions in the image on the lower left. In addition, the generation of portions of high Bi concentration in the vicinity thereof was also confirmed (exemplary corresponding portions are shown by the arrows in the figure), in the image on the lower right in FIG. 9 (*b*). In addition, the results of Comparative Example 3 for the casting defect test are shown in FIG. 7. Minute indications were observed in the central region of each of the 10 mm to 30 mm-thick stepped portions in the thickness direction, and occurrence of minute shrinkage cavities was confirmed. Note that the indications observed at the upper portion of the outer periphery and at the right end portion of the outer periphery of the 30 mm-thick portion of the step-shaped sample of Comparative Example 3 are regions which were colored due to the penetrant remaining on the surfaces of the sample other than the surface to be observed, and they are unrelated to casting defects.

Next, Comparative Example 4, Examples 9 and 10, Example 2, Examples 11 and 12, and Comparative Example 5, shown in the fourth group in Table 2 will be described. These alloys were prepared to have a varying P content with Example 2 having roughly an intermediate value, and with the contents of other elements being as close to each other as possible, and they are arranged in the order based on the P content. As with the above, the results for the machinability test are shown in Table 2, FIG. 6 and FIG. 10; and the results for the casting defect test are shown in FIG. 7, except for Examples 10 and 11. The alloy of Comparative Example 4, having a P content of less than 0.005% by mass, had a problem in the flowability of molten metal, and in addition, slight shrinkage cavities were observed. On the other hand, in the alloy of Comparative Example 5, having a P content exceeding 0.1% by mass, casting defects such as gas defects, shrinkage cavities and tin sweat were observed. Each of the alloys in this group exhibited short drilling time, and produced sheared machining chips in the lathe machining test, resulting in a good overall machinability. Note that the indications observed at the upper portion of the outer periphery and at the right end portion of the outer periphery of the 30 mm-thick portion of the step-shaped sample of Example 12, and at the corner of the boundary between the 20 mm- and 30 mm-thick portions of the sample of Example 4, are regions which were colored due to the penetrant remaining on the surfaces of the samples other than the surface to be observed, and they are unrelated to casting defects.

Next, Comparative Example 6, Example 13, Example 2, Examples 14 and 15, and Comparative Examples 7 to 9 shown in the fifth group in Table 2 will be described. These alloys were prepared to have a varying Bi content with Example 2 having roughly an intermediate value, and arranged in the order based on the Bi content. As with the above, the results for the machinability test are shown in Table 2 and FIG. 10, except for Comparative Examples 8 and 9; and results for the casting defect test are shown in FIG. 7, except for the Example 14. The alloy of Comparative Example 6, having a Bi content of less than 0.2% by mass, required a drilling time which was 10 times longer as compared to that of CAC406, and it produced helically-coiled machining chips, resulting in a poor machinability. In addition, a distinctly colored indication was observed in the casting defect test, and shrinkage cavities were also observed. The alloy of Comparative Example 7, having a Bi content exceeding 0.9% by mass, exhibited poor mechanical properties, despite excellent machinability. In addition, occurrence of gas defects and shrinkage cavity defects was also observed. In the alloys of Comparative Examples 8 and 9, to which excessive Bi was added and which were examined for the mechanical properties and casting defects, problems in mechanical properties were confirmed, with Comparative Example 8 exhibiting a poor tensile strength, and Comparative Example 9 exhibiting a poor tensile strength and elongation. Further, in the casting defect test, indications were observed in both Comparative Examples 8 and 9, and occurrence of gas defects and shrinkage cavity defects was confirmed.

The alloys of Examples 16 to 18 and Comparative Example 10 were prepared to have a composition similar to that of Example 2, to which B as a trace element was added. As with the above, the results for the machinability test are shown in Table 2 and FIG. 10; and the results for the casting defect test are shown in FIG. 7, except for Example 17. Although the incorporation of B significantly improved the flowability of molten metal, in the alloy of Comparative Example 10 including an excessive amount of B, the tensile strength was significantly decreased. Further, in Comparative Example 10, the occurrence of gas defects and shrinkage cavities was observed, as a result of increased B content. Each of these alloys in this group exhibited good results in each of the tests for machinability.

The alloys of Examples 19 to 22 were prepared to have a composition similar to that of Example 2, to which Ni as a trace element was added. It was shown that, if the Ni content was less than 0.5% by mass, the properties required for the alloy according to the present invention can be obtained.

<Ni Leaching Test>

Ni-containing copper alloys each having the blending ratio as shown in Table 3 were prepared, in the same manner as described above. The leaching test was carried out for these alloys in accordance with JIS S3200-7 "Equipment for water supply service. Test methods of effect to water quality". Specifically, square rod samples having a size of 28×28×100 mm are cast using alloys each having the blending ratio shown in Table 3, which are then machined to a size of 25×25×10 mm. After washing the thus obtained samples, the leaching test is carried out using a leachate. Washing is performed for 1 hour using tap water, followed by washing with water for 3 times. Then first end of a sample pipe was stopped hermetically with a plug wrapped with a polyethylene film washed with water, and the interior of the sample pipe was filled with a leachate having a temperature of 23 degrees Celsius and then sealed. The resultant was allowed to rest for 16 hours, while maintaining the liquid temperature. The sample solution is then collected into a bottle made of hard glass, which has been washed with nitric acid first and then washed with water.

The composition of the leachate used in the leaching test is as follows. First, to 900 mL of water, 1 mL of sodium hypochlorite solution (hydrochloric acid concentration: 0.3 mg/mL), 22.5 mL of sodium hydrogen carbonate solution (0.04 mol/L), 11.3 mL of calcium chloride solution (0.04 mol/L) are added, followed by further addition of water, to prepare a solution having a final volume of 1 L. The pH of the resulting solution is adjusted using hydrochloric acid and sodium hydroxide solution, to obtain a leachate having a pH of 7.0±0.1, hardness of 45±5 mg/L, alkalinity of 35±5 mg/L, and residual chlorine of 0.3±0.1 mg/L.

The Ni concentration in the collected sample solution is measured, and the measured value is defined as the amount of Ni leaching. However, since the reference value for Ni leaching is not specified in JIS S3200-7, the guideline value defined by World Health Organization (WHO) was used as the reference value, and the Ni leaching was evaluated as follows: those having the Ni content of 0.07 mg/L or less is evaluated as "○"; and those having the Ni content of greater than 0.07 mg/L is evaluated as "x".

The alloys of Examples 23 to 25 have the Ni content of less than 0.5% by mass, and Comparative Example 12 has the Ni content exceeding the upper limit. Ni leaching test was carried out for these copper alloys. In Comparative Example 12, the amount of Ni leaching exceeded 0.07 mg/L.

| | Cu | Zn | Sn | Ni | P | Bi | Pb | B | Ni leaching mg/L | Evaluation 0.07 mg/L or lower |
|---|---|---|---|---|---|---|---|---|---|---|
| Example 23 | 81.21 | 15.83 | 2.36 | 0.10 | 0.023 | 0.48 | 0 | 0 | 0.014 | ○ |
| Example 24 | 80.84 | 16.12 | 2.29 | 0.26 | 0.026 | 0.47 | 0 | 0 | 0.038 | ○ |
| Example 25 | 80.95 | 15.70 | 2.37 | 0.47 | 0.025 | 0.49 | 0 | 0 | 0.060 | ○ |
| Comparative Example 12 | 80.02 | 16.12 | 2.39 | 0.95 | 0.025 | 0.50 | 0 | 0 | 0.120 | x |

The invention claimed is:

1. A copper alloy for forming a member for use in water works, said copper alloy consisting of:

less than 0.5% by mass of Ni;

0.2% by mass or more and 0.9% by mass or less of Bi;

12.0% by mass or more and 20.0% by mass or less of Zn;

1.5% by mass or more and 4.5% by mass or less of Sn; and 0.005% by mass or more and 0.1% by mass or less of P;

Cu; and unavoidable impurities;

wherein a total content of Zn and Sn is within a range of 13.5% to 21.5% by mass, inclusive.

2. A copper alloy for forming a member for use in water works, said copper alloy consisting of:

less than 0.5% by mass of Ni;

0.2% by mass or more and 0.9% by mass or less of Bi;

12.0% by mass or more and 20.0% by mass or less of Zn;

1.5% by mass or more and 4.5% by mass or less of Sn;

0.005% by mass or more and 0.1% by mass or less of P;

0.0003% by mass or more and 0.006% by mass or less of B;

Cu; and unavoidable impurities;

wherein a total content of Zn and Sn is within a range of 13.5% to 21.5% by mass, inclusive.

* * * * *